United States Patent [19]

Mitchell

[11] Patent Number: 4,780,974

[45] Date of Patent: Nov. 1, 1988

[54] OFFSET PRINTING TAG ASSEMBLY

[76] Inventor: Donald B. Mitchell, 515 West Highland, Phoenix, Ariz. 85013

[21] Appl. No.: 1,742

[22] Filed: Jan. 9, 1987

Related U.S. Application Data

[63] Continuation of Ser. No. 534,759, Sep. 22, 1983.

[51] Int. Cl.[4] ..... A44C 3/00

[52] U.S. Cl. ..... 40/299

[58] Field of Search ..... 40/2 R, 21 R; 428/43; D20/22, 27, 40

[56] References Cited

U.S. PATENT DOCUMENTS

| | | | |
|---|---|---|---|
| D. 59,194 | 10/1921 | Collins | D20/22 |
| 257,017 | 4/1882 | Keller | 40/2 R |
| 492,764 | 2/1893 | Libbey | 40/2 R |
| 526,590 | 9/1894 | Terrill | 40/2 R |
| 1,563,843 | 12/1925 | Flood | 40/2 R |
| 1,597,533 | 8/1926 | Meyers | 40/2 R |
| 2,937,464 | 5/1960 | Marshall | 40/2 R |
| 2,987,840 | 6/1961 | Marshall et al. | 40/2 R |
| 3,462,864 | 8/1969 | Merser | 40/2 R |
| 3,703,044 | 11/1972 | Gregory | 40/2 R |

*Primary Examiner*—Robert Peshock
*Assistant Examiner*—Cary E. Stone
*Attorney, Agent, or Firm*—Cahill, Sutton & Thomas

[57] ABSTRACT

A tag assembly for use on offset printers comprising a sheet formed of a number of separable parts with each detached part forming a shipping tag. The tags are arranged in pairs extending along the longitudinal axis of the sheet, with the tags of each pair being arranged in side-by-side abutting arrangement, their abutting edges forming a perforated line. The top edges of the first pair of tags forms the top of the sheet, and the bottom edges of the second pair of tags forms the bottom of the sheet. The top edges of the second pair of tags are connected to the bottom edges of the first pair of tags along a perforated line. Each tag is provided with a reinforced hole along its top edge, leaving the bottom of the sheet uncluttered for gripping by the offset printer.

10 Claims, 1 Drawing Sheet

OFFSET PRINTING TAG ASSEMBLY

This application is a continuation of Design U.S. patent application Ser. No. 06/534,759 filed Sept. 22, 1983 and entitled OFFSET PRINTING TAG ASSEMBLY.

FIELD OF THE INVENTION

The present invention relates to shipping tags, and more particularly to a design for multiple tags in gangs with emphasis on features that are intended to accommodate the operating requirements of an offset printing press used for printing information on such tags in their final step of fabrication.

BACKGROUND OF THE INVENTION

Tags of various types are widely used in the manufacture, shipping and merchandising of numerous types of articles. One tag of particular interest is the commonly known shipping tag that usually comprises a rectangular tag of thin cardboard that is secured to an article by means of a cord or wire. The cord passes through a hole or eyelet formed in one end of the tag. Such tags are employed for a variety of uses in shipping, parts identification, pricing, repair instructions, baggage identification and the like. Retailers, wholesalers, parts houses, auto dealers, real estate offices, furniture stores, appliance shops, beverage suppliers and manufacturers use untold numbers of such tags in every day operations.

While the cost of a single tag is so low as to appear inconsequential, the high volume usage of the tags makes cost an important consideration. Because of the high volume, numerous potential suppliers of the tag are attracted by the apparent opportunity for a profitable business enterprise. Tag producers are thus highly competitive, and a seemingly minor design feature that reduces the manufacturing cost of the printed tag can prove to be of great importance in a competitive business climate of this nature.

The production of tags typically involves a sequence of operations wherein the tags are first cut to size and shape, a hole is punched in one end of each tag and the desired information or format is then printed on the tag. When the hole is to be reinforced, an additional layer of cardboard is secured to the areas immediately surrounding the hole on one or both sides of the tag. This is preferably done prior to the printing operation. The reinforcing cardboard used for reinforcing the hole in the tag may be secured to the card forming the tag by any of various types of adhesives, or by means of metal eyelets that are crimped in place through the hole and over the edges of the surrounding card forming the tag.

Because of the relatively small size of the individual tags, the tags are commonly fabricated in strips or in gangs of four or eight, held together along their perforated edges. Such a sheet or strip of tags may be cut and fabricated as a unit, so that the total number of required machine strokes to produce the tags is significantly reduced, and the production costs accordingly.

In the interest of achieving a short turn around time in the filling of orders for printed tags, it is important that the printing operation be held up until the last step in the production of the tags. Very often the customer requires a new supply of tags on very short notice. If the tag supplier has a stock of unprinted but otherwise completed tags on hand, and if the printing operation can be completed very quickly, an important competitive advantage can be realized over other suppliers who may not be able to react so quickly.

Most tag suppliers experience difficulties in providing a service of this kind. A rapid printing operation calls for printing by means of an offset printer which employs rapid photographic operations in place of the much slower type-setting procedures involved with other types of printers. The typical tag construction, however, does not lend itself to offset printing, because the reinforcing "patch" around the punched hole in the tag is often too thick to permit a smooth and rapid printing operation. The thick patch produces vibrations in the printer rollers and causes the printing blanket to wear out prematurely. Furthermore, the prior art gang arrangements of prior art tags are not properly designed to accommodate the functional requirements of the offset printer. Because the prior art gang arrangements do not provide an unobstructed gripping area at the leading edge of the sheet or gang of tags, the machine cannot be fed automatically, and must be fed by hand, one sheet at a time. For these reasons, a printing operation that could otherwise be completed in a matter of minutes might require several hours for completion.

Therefore, in order to satisfy the need for quick turn around time and low production costs for shipping tags, an improved tag design and more particularly, an improved gang arrangement of tags is required to permit the rapid and economical printing thereof on an offset printer.

DESCRIPTION OF THE PRIOR ART

Various forms of tag construction and gang arrangements of tags are described in the prior art.

U.S. Pat. No. 257,017 discloses a tag or ticket with perforations along its edges to facilitate attachment to a garment by sewing through the perforations. The tags are supplied in strips in which the individual tags are held together at their longer edges.

U.S. Pat. No. 492,764 discloses a conductor's registering trip slip comprising a multiplicity of tickets secured to a cardboard carrier. The carrier is an elongated cardboard strip with a longitudinal centerline. The individual tickets are secured at one end along the centerline, with half the tickets extending laterally therefrom in one direction and half in the opposite direction. The tickets are torn from the carrier and given to passengers as receipts when fares are paid. No holes or attachment means are incorporated in the tickets.

U.S. Pat. No. 526,590 describes an advertising shipping tag which provides a gang of eight tags arranged in a sheet with four tags extending to the right and four to the left of the longitudinal centerline of the sheet. The attachment holes of individual tags are arranged along the outer edges of the sheet so that the tags to the right of the centerline are joined at their lower or "toe" ends to the lower ends of their opposite counterparts. This arrangement is designed to permit the sheet of gang tags to be folded into a self-securing package for mailing as a promotional offering.

U.S. Pat. No. Des. 59,194 discloses an ornamental design for a tag, incorporating a stylized reinforcement means at the attachment hole.

U.S. Pat. No. 1,563,843 discloses a strip of tags joined at their perforated edges with the attachment holes carrying attachment cords extending along a common edge of the strip. The cords are drawn into slits extending outwardly from the outer edges of the holes so that the cords are urged to extend laterally from the edge of the strip where they will not interfere with subsequent printing operations and also so that the untied cords will not become disengaged from the tags prior to use.

U.S. Pat. No. 1,597,533 describes a data recording system and ticket assembly comprising a pair of tickets attached together at their longer perforated edges. Also attached to the two tickets are a customer voucher and a pocket or envelope for receiving other transaction slips. The attachment ends of both tickets extend from the same side of the assembly.

U.S. Pat. No. 2,937,464 discloses a tag with a fastening wire, the tag incorporating a means for securing the free ends of the fastening wire so that when a multiplicity of such tags is manufactured in roll form, the wires will not protrude from the edge of the roll. Dislocation of the wires is thereby prevented. Handling by automatic machinery is also facilitated. The attachment ends of the tags extend from one edge of the strip or roll of tags.

U.S. Pat. No. 2,987,840 discloses a combination booklet tag manufactured in strip form wherein individual tags are joined at their perforated edges with the attachment ends of all of the tags extending from the same edge of the strip. Each tag has a coupon portion with a booklet attached to the coupon portion.

U.S. Pat. No. 3,462,864 discloses a tag and an attachment means with the attachment means comprising a filament that is pressed into a hole at one end of the tag. The filament is then compressed longitudinally so that it expands radially to secure its position in the hole.

The 1976 issue of *Dennison Consumer Products* offers shipping tags in gangs of four, wherein the four tags are attached side-by-side along their knife slotted edges with their attachment ends extending along one edge of the gang arrangement.

Thus, prior art is seen to encompass a variety of tag designs and gang arrangements intended to achieve an advantage related to functionality or manufacturing cost. Although the printing operation accounts for a significant portion of the total manufacturing cost of the tags, none of the prior art designs and gang arrangements is specifically directed toward an improved accommodation of the printing operation. More specifically, none of the prior art gang arrangements is suitable for printing on an offset printer.

SUMMARY OF THE INVENTION

In accordance with the invention claimed, an improved gang arrangement of tags is provided which is designed specifically for accommodation of the functional characteristics of the offset printer.

It is, therefore, one object of this invention to provide a gang arrangement of four or more tags with reinforced attachment holes that may be readily printed on an offset printer.

Another object of this invention is to provide such an arrangement of tags in sheet form wherein the reinforced attachment holes or patches do not encroach upon the gripping area required by the offset printer along the leading edge of the sheet of tags.

A further object of this invention is to provide such a sheet of tags in an arrangement that yields a "greater pull" through the offset printer than heretofore possible, since the length of the sheet in the direction of travel through the printer is substantially greater than its width, thereby moving smoothly through the printer.

A still further object of this invention is to provide such an improved arrangement of tags in sheet or gang form which, by virtue of its free gripping edge, lends itself readily to rapid automatic feed into an offset printer.

A still further object of this invention is to provide such an arrangement of gang tags in sheet form which, by virtue of its "greater pull", permits the smooth and rapid operation of the associate offset printer.

A still further object of this invention is to provide such an arrangement of gang tags in sheet form together with reinforcement patches of mylar or other relatively thin but tough materials that do not interfere with the smooth and rapid operation of the associated offset printer.

A still further object of this invention is to provide such a gang arrangement of tags in sheet form which, by virtue of its adaptability to offset printing, permits the economical printing of the tags as the last step in tag production, thereby rapidly meeting customer demands.

Yet another object of this invention is to provide an arrangement of tags in sheet form which, by virtue of its adaptability to offset printing, yields particularly low tag production costs.

Further objects and advantages of this invention will become apparent as the following description proceeds, and the features of novelty which characterize the invention will be pointed out with particularity in the claims annexed to and forming a part of this specification.

BRIEF DESCRIPTION OF THE DRAWING

The present invention may be more readily described with reference to the accompanying drawing, in which.

DESCRIPTION OF THE PREFERRED EMBODIMENT

Figure 1:
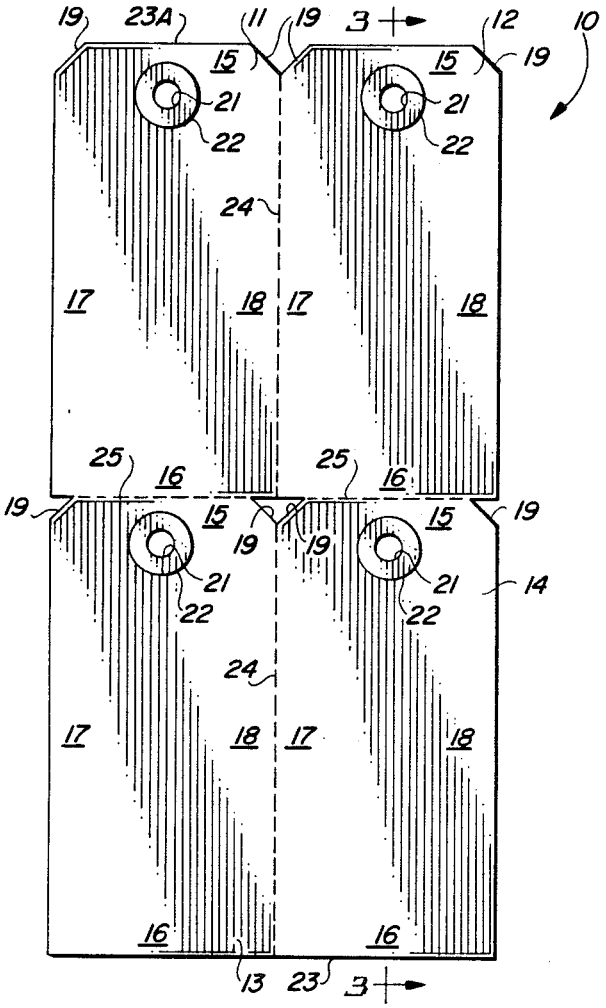
FIG. 1 is a plan view of the gang arrangement of tags embodying the invention.
Figure 3:
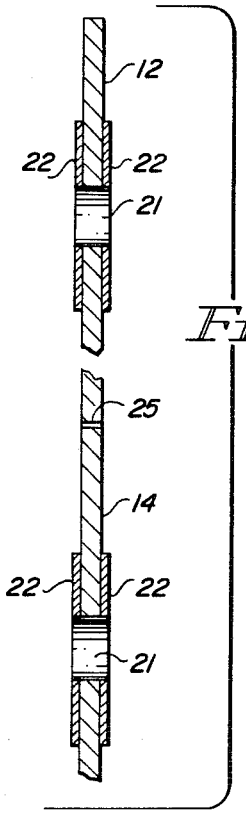
FIG. 3 is a cross-sectional view of FIG. 1 taken along the line 3—3.
Figure 4:
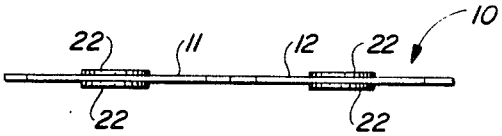
FIG. 4 is a top view of the arrangement shown in FIG. 1.

Referring more particularly to the drawing by characters of reference, FIG. 1–4 disclose a gang arrangement of identical tags in sheet form wherein gang sheet 10 comprises four tags 11–14.

Each of tags 11–14 has an upper end 15, a lower end 16, a left-hand edge 17 and a right-hand edge 18. The individual tags 11–14 are rectangular in shape, and are approximately twice as long as measured from end 15 to end 16 as they are wide. For appearance, the corners 19 at end 15 are beveled, as shown in FIG. 1.

The tags are intended to be attached to articles for identification purposes using wires or cords (not shown) that are passed through reinforced attachment holes 21. Each tag has a circular attachment hole 21 located at the center of its upper end 15, having a diameter of approximately one-fourth inch, and is reinforced by two ring-shaped patches 22. The two patches are secured by an adhesive, one to each face of the tag. The openings in patches 22 are aligned with hole 21, and have the same diameter as hole 21. The outside diameters of patches 22 are approximately three times their inside diameters.

For best results when the tags are to be printed on an offset printer, patches 22 should be as thin as possible, consistent with obtaining adequate strength. Mylar or polypropylene or any other suitable plastic patches have been found to give good service for this purpose. Patches from these materials with a thickness of seven thousandths of an inch have been found to give adequate reinforcement, and their interference with the operation of the offset printer is negligible relative to that produced by paper or cardboard patches that are typically ten thousandths of an inch thick.

Figure 2:
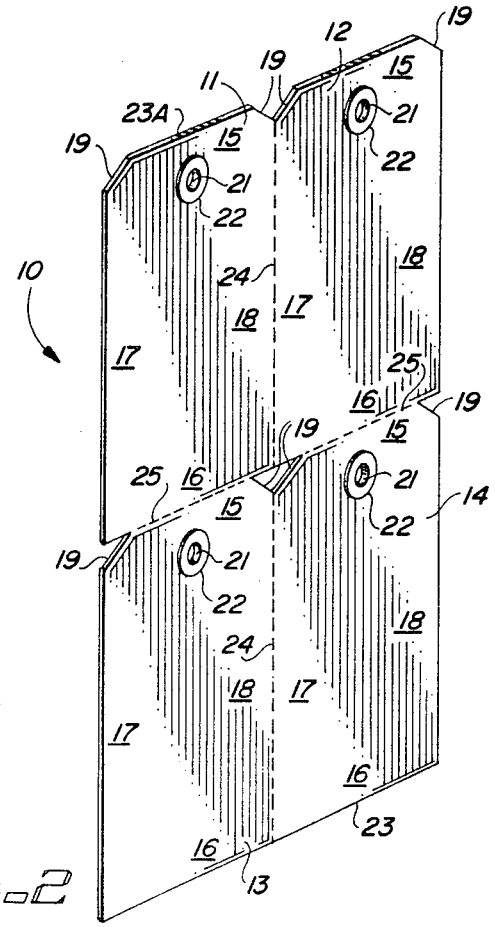
FIG. 2 is a perspective view of the arrangement shown in FIG. 1 as seen from the back side.

As shown in FIGS. 1 and 2, sheet 10 is formed by arranging two pairs of tags, one above the other. The first pair comprises tags 11 and 12 which are placed side-by-side, the left-hand edge 17 of tag 12 abutting the right-hand edge 18 of tag 11. The second pair comprises tags 13 and 14 placed side-by-side in the same manner. The first pair is placed above the second pair with the lower ends 16 of tags 11 and 12 abutting the upper ends 15 of tags 13 and 14, respectively. In this arrangement, the bottom or lower end 23 of sheet 10 is seen to be free of reinforced holes which are relegated to a first grouping across the center and a second grouping across the top or upper end 23A of the sheet.

The adjacent or abutting edges of the tags 11–14 are defined by perforated lines 24 and 25 which define a longitudinal axis 24 and a lateral axis 25 bisecting sheet 10 longitudinally and laterally, respectively. Longitudinal axis 24 defines a feed axis for gag sheet 10. After the sheet of tags has been printed, the four individual tags forming the sheet may be separated by tearing along perforated lines 24 and 25.

Sheet 10 is intended to be fed bottom end first into an offset printer having a feed path aligned with the longitudinal axis of sheet 10. With automatic feed, lower ends 16 of tags and 14 are gripped by mechanical fingers and drawn into the printer exposing the next underlying sheet 10 of a stack of sheets which are sequentially fed one at a time into the printer. The upper surface of lower ends 16 of the lower tags 13 and 14 is free of patches and attachment holes and serves as an unobstructed gripping surface for rapid and effective automatic pickup and feeding of sheet 10 by the mechanical fingers of the printer.

The requirement for a "longer pull length than width" of the sheet of tags is also met by virtue of the proportions of sheet 10 and its direction of travel through the printer. As indicated earlier, sheet 10 is approximately twice as long as it is wide, and the free gripping edge at end 23 permits a longitudinal pull or travel consistent with this requirement.

The arrangement of the four tags 11–14 to form sheet 10 as just described, is thus seen to accommodate the specific functional requirements of the offset printer which have been ignored by prior art tag arrangements. Dramatic improvements in printing speed and important reductions in turn around times associated with the processing of orders have resulted accordingly. Order processing can be completed, if necessary, while the customer waits. Thus, printers are now calling for tags of the type disclosed and claimed herein over prior art tags available in the marketplace.

Although but a single embodiment of the invention has been illustrated and described, it will be apparent to those skilled in the art that various changes and modifications may be made therein without departing from the spirit of the invention or from the scope of the appended claims.

What is claimed is:

1. A tag assembly configured to be compatible with an offset printing press having a feed path and a feed assembly, comprising: a single substantially rectangular sheet having a top, a bottom and opposing sides defining a continuous sheet perimeter, said sheet including first and second linear perforation lines defining a longitudinal axis and a lateral axis bisecting said sheet into four equal tag sections each having a top, a bottom and two opposing sides, the tag sections lying above the lateral axis defining a first pair of tag sections and the tag sections lying below the lateral axis defining a second pair of tag sections, each tag section including a hole located in proximity to the top of each tag section and centered with respect to the sides of each tag section, the holes in each pair of tag sections being symmetrically disposed with respect to the longitudinal axis, the bottom and the adjacent surface of said rectangular sheet forming an unobstructed feed surface for insertion into the feed path of said printing press with the longitudinal axis of said sheet centered about and in alignment with the feed path, the area below the holes and above the bottom of the second pair of tag sections defining a clear zone for enabling the feed assembly of said printing press to grip said rectangular sheet.

2. The tag assembly of claim 1 wherein the top of each rectangular tag section includes first and second spaced apart bevelled edges.

3. The tag assembly of claim 2 wherein the intersection of the bottom surface of the first pair of tag sections with the bevelled top surface of the second pair of tag sections define a triangular aperture about the intersection of the longitudinal axis with the lateral axis.

4. The tag assembly of claim 3 wherein the continuous perimeter of said rectangular sheet forms a smooth, uniform edge surface.

5. The tag assembly of claim 4 wherein the length of said rectangular sheet is approximately equal to twice the width of said sheet.

6. The tag assembly of claim 5 wherein said rectangular sheet includes an upper surface and a lower surface and wherein each hole is surrounded by a reinforcement patch.

7. The tag assembly of claim 6 wherein the reinforcement patch includes a patch on the upper surface of each tag section and a second patch on the lower surface of each tag section.

8. The tag assembly of claim 6 wherein said rectangular sheet is formed from semi-rigid paper stock.

9. The tag assembly of claim 8 wherein said reinforcement patch is circular in shape and includes an outside diameter approximately three times greater than the diameter of the associated hole.

10. The tag assembly of claim 1 wherein laterally opposing tag sections are symmetrical with respect to the longitudinal axis and asymmetrical with respect to the lateral axis.

* * * * *